US009020815B2

(12) United States Patent
Gao

(10) Patent No.: US 9,020,815 B2
(45) Date of Patent: Apr. 28, 2015

(54) SPECTRAL ENVELOPE CODING OF ENERGY ATTACK SIGNAL

(71) Applicant: Huawei Technologies Co., Ltd., Shenzhen, Guangdong (CN)

(72) Inventor: Yang Gao, Mission Viejo, CA (US)

(73) Assignee: Huawei Technologies Co., Ltd., Shenzhen (CN)

( * ) Notice: Subject to any disclaimer, the term of this patent is extended or adjusted under 35 U.S.C. 154(b) by 149 days.

(21) Appl. No.: 13/888,550

(22) Filed: May 7, 2013

(65) Prior Publication Data

US 2013/0317813 A1 Nov. 28, 2013

Related U.S. Application Data

(63) Continuation of application No. 12/554,848, filed on Sep. 4, 2009, now Pat. No. 8,463,603.

(60) Provisional application No. 61/094,885, filed on Sep. 6, 2008.

(51) Int. Cl.

| | |
|---|---|
| ***G10L 19/00*** | (2013.01) |
| ***G10L 19/12*** | (2013.01) |
| ***G10L 19/022*** | (2013.01) |
| ***G10L 19/03*** | (2013.01) |
| *G10L 19/02* | (2013.01) |
| *G10L 19/025* | (2013.01) |

(52) U.S. Cl.

CPC ..... *G10L 19/12* (2013.01); *G10L 19/0212* (2013.01); *G10L 19/022* (2013.01); *G10L 19/025* (2013.01); *G10L 19/03* (2013.01)

(58) Field of Classification Search

USPC ..... 704/219, 226, 206, 205, 228

See application file for complete search history.

(56) References Cited

U.S. PATENT DOCUMENTS

| | | | | |
|---|---|---|---|---|
| 5,731,767 | A * | 3/1998 | Tsutsui et al. | 341/50 |
| 5,752,224 | A | 5/1998 | Tsutsui et al. | |
| 5,901,234 | A * | 5/1999 | Sonohara et al. | 381/104 |
| 5,974,379 | A | 10/1999 | Hatanaka et al. | |
| 2009/0313009 | A1 | 12/2009 | Kovesi et al. | |

OTHER PUBLICATIONS

Office Action dated Oct. 12, 2012 in connection with U.S. Appl. No. 12/554,848.

"G.729-based embedded variable bit-rate coder: An 8-32 kbit/s scalable wideband coder bitstream interoperable with G.729", International Telecommunication Union, ITU-T Recommendation G.729.1, May 2006, 98 pages.

* cited by examiner

*Primary Examiner* — Qi Han

(57) ABSTRACT

MDCT or FFT-based audio coding algorithms often have the problem named here spectral pre-echoes when coding an energy attack signal. This invention presents several possibilities to avoid the spectral pre-echoes existing in decoded signal segment before the energy attack point. The spectral envelope before the attack point can be improved by performing spectrum smoothing, replacing the segment of having spectral pre-echoes or filtering the segment with a combined filter obtained by doing LPC analysis.

12 Claims, 12 Drawing Sheets

Example of original energy attack signal in time domain

Prior Art

High-level block diagram of the TDBWE encoder for G.729.1

Prior Art

High-level block diagram of the G.729.1 TDAC encoder

Prior Art

High-level block diagram of the G.729.1 decoder

Prior Art

High-level block diagram of the TDBWE decoder for G.729.1

Prior Art

Block diagram of the G.729.1 TDAC decoder

Example of original energy attack signal in time domain

Spectrum of the signal before the attack point

Spectrum of the signal after the attack point

Example of decoded energy attack signal in time domain without modification of the spectral envelope Example of basic principle of audio decoding with BWE

SPECTRAL ENVELOPE CODING OF ENERGY ATTACK SIGNAL

CROSS-REFERENCE TO RELATED APPLICATIONS

This application is a continuation of U.S. patent application Ser. No. 12/554,848, filed on Sep. 4, 2009, which claims priority to U.S. Provisional Application No. 61/094,885 filed on Sep. 6, 2008, both of which are hereby incorporated by reference in their entireties.

TECHNICAL FIELD

The present invention is generally in the field of transform coding. In particular, the present invention is in the field of low bit rate transform coding.

BACKGROUND

In modern audio/speech signal compression technologies, frequency domain coding has been widely used in various ITU-T, MPEG, and 3 GPP standards. If bit rate is very low, a concept of BandWidth Extension (BWE) is well possible to be used. No matter which spectral coding approach is used, spectral envelope coding is often needed. The technology concept of BWE sometimes is also called High Band Extension (HBE) or SubBand Replica (SBR). Although the name could be different, they all have the similar meaning of encoding/decoding some frequency sub-bands (usually high bands) with little budget of bit rate or significantly lower bit rate than normal encoding/decoding approach. BWE often encodes/decodes some perceptually critical information within bit budget while generating some information with very limited bit budget or without spending any number of bits; it usually comprises frequency envelope coding, temporal envelope coding (optional), and spectral fine structure generation. The precise description of the spectral fine structure needs a lot of bits, which becomes not realistic for any BWE algorithm. A realistic way is to artificially generate the spectral fine structure and only spend limited bit budget to code the fine spectral envelope. Obviously, the spectral envelope coding is the most important first step toward successful BWE algorithm; it is also important to any other spectral coding algorithms.

Frequency domain can be defined as FFT transformed domain; it can also be in MDCT (Modified Discrete Cosine Transform) domain. One of the pre-art BWE algorithms can be found in the standard ITU-T G.729.1 in which the algorithm is named as TDBWE (Time Domain Bandwidth Extension).

General Description of ITU G.729.1

ITU-T G.729.1 is also called G.729EV coder which is an 8-32 kbit/s scalable wideband (50-7000 Hz) extension of ITU-T Rec. G.729. By default, the encoder input and decoder output are sampled at 16000 Hz. The bitstream produced by the encoder is scalable and consists of 12 embedded layers, which will be referred to as Layers 1 to 12. Layer 1 is the core layer corresponding to a bit rate of 8 kbit/s. This layer is compliant with G.729 bitstream, which makes G.729EV interoperable with G.729. Layer 2 is a narrowband enhancement layer adding 4 kbit/s, while Layers 3 to 12 are wideband enhancement layers adding 20 kbit/s with steps of 2 kbit/s.

This coder is designed to operate with a digital signal sampled at 16000 Hz followed by conversion to 16-bit linear PCM for the input to the encoder. However, the 8000 Hz input sampling frequency is also supported. Similarly, the format of the decoder output is 16-bit linear PCM with a sampling frequency of 8000 or 16000 Hz. Other input/output characteristics should be converted to 16-bit linear PCM with 8000 or 16000 Hz sampling before encoding, or from 16-bit linear PCM to the appropriate format after decoding. The bitstream from the encoder to the decoder is defined within this Recommendation. The G.729EV coder is built upon a three-stage structure: embedded Code-Excited Linear-Prediction (CELP) coding, Time-Domain Bandwidth Extension (TDBWE) and predictive transform coding that will be referred to as Time-Domain Aliasing Cancellation (TDAC). The embedded CELP stage generates Layers 1 and 2 which yield a narrowband synthesis (50-4000 Hz) at 8 and 12 kbit/s. The TDBWE stage generates Layer 3 and allows producing a wideband output (50-7000 Hz) at 14 kbit/s. The TDAC stage operates in the Modified Discrete Cosine Transform (MDCT) domain and generates Layers 4 to 12 to improve quality from 14 to 32 kbit/s. TDAC coding represents jointly the weighted CELP coding error signal in the 50-4000 Hz band and the input signal in the 4000-7000 Hz band.

The G.729EV coder operates on 20 ms frames. However, the embedded CELP coding stage operates on 10 ms frames, like G.729. As a result two 10 ms CELP frames are processed per 20 ms frame. In the following, to be consistent with the text of ITU-T Rec. G.729, the ms frames used by G.729EV will be referred to as superframes, whereas the 10 ms frames and the 5 ms subframes involved in the CELP processing will be respectively called frames and subframes. In this G.729EV, TDBWE algorithm is related to our topics.

G729.1 Encoder

A functional diagram of the encoder part is presented in FIG. 1. The encoder operates on 20 ms input superframes. By default, the input signal 101, $s_{WB}(n)$, is sampled at 16000 Hz. Therefore, the input superframes are 320 samples long. The input signal $s_{WB}(n)$ is first split into two sub-bands using a QMF filter bank defined by the filters $H_1(z)$ and $H_2(z)$. The lower-band input signal 102, $s_{LB}^{qmf}(n)$, obtained after decimation is pre-processed by a high-pass filter $H_{h1}(z)$ with 50 Hz cut-off frequency. The resulting signal 103, $s_{LB}(n)$, is coded by the 8-12 kbit/s narrowband embedded CELP encoder. To be consistent with ITU-T Rec. G.729, the signal $s_{LB}(n)$ will also be denoted s(n). The difference 104, $d_{LB}(n)$, between s(n) and the local synthesis 105, $\hat{s}_{enh}(n)$, of the CELP encoder at 12 kbit/s is processed by the perceptual weighting filter $W_{LB}(z)$. The parameters of $W_{LB}(z)$ are derived from the quantized LP coefficients of the CELP encoder. Furthermore, the filter $W_{LB}(z)$ includes a gain compensation which guarantees the spectral continuity between the output 106, $d_{LB}^{w}(n)$, of $W_{LB}(z)$ and the higher-band input signal 107, $S_{HB}(n)$. The weighted difference $d_{LB}^{w}(n)$ is then transformed into frequency domain by MDCT. The higher-band input signal 108, $s_{HB}^{fold}(n)$, obtained after decimation and spectral folding by $(-1)^n$ is pre-processed by a low-pass filter $H_{h2}(z)$ with 3000 Hz cut-off frequency. The resulting signal $s_{HB}(n)$ is coded by the TDBWE encoder. The signal $s_{HB}(n)$ is also transformed into frequency domain by MDCT. The two sets of MDCT coefficients 109, $D_{HB}^{w}(k)$, and 110, $S_{HB}(k)$, are finally coded by the TDAC encoder. In addition, some parameters are transmitted by the frame erasure concealment (FEC) encoder in order to introduce parameter-level redundancy in the bitstream. This redundancy allows improving quality in the presence of erased superframes.

TDBWE Encoder

The TDBWE encoder is illustrated in FIG. 2. The TDBWE encoder extracts a fairly coarse parametric description from the pre-processed and down-sampled higher-band signal 201, $s_{HB}(n)$. This parametric description comprises time envelope 202 and frequency envelope 203 parameters. The 20 ms input speech superframe $S_{HB}(n)$ (8 kHz sampling frequency) is subdivided into 16 segments of length 1.25 ms each, i.e., each segment comprises 10 samples. The 16 time envelope parameters 102, $T_{env}(i)$ i=0, . . . , 15, are computed as logarithmic subframe energies before the quantization. For the computation of the 12 frequency envelope parameters 203, $F_{env}(j)$, j=0, . . . , 11, the signal 201, $s_{HB}(n)$, is windowed by a slightly asymmetric analysis window. This window is 128 tap long (16 ms) and is constructed from the rising slope of a 144-tap Hanning window, followed by the falling slope of a 112-tap Hanning window. The maximum of the window is centered on the second 10 ms frame of the current superframe. The window is constructed such that the frequency envelope computation has a lookahead of 16 samples (2 ms) and a lookback of 32 samples (4 ms). The windowed signal is transformed by FFT. The even bins of the full length 128-tap FFT are computed using a polyphase structure. Finally, the frequency envelope parameter set is calculated as logarithmic weighted sub-band energies for 12 evenly spaced and equally spaced and equally wide overlapping sub-bands in the FFT domain.

G.729.1 TDAC Encoder (Layers 4 to 12)

The Time Domain Aliasing Cancellation (TDAC) encoder is illustrated in FIG. 3. The TDAC encoder represents jointly two split MDCT spectra 301, $D_{LB}^{w}(k)$, and 302, $S_{HB}(k)$, by gain-shape vector quantization. $D_{LB}^{w}(k)$ represents CELP coding error in weighted spectrum domain of [0.4 kHz]; $S_{HB}(k)$ is the unquantized weighted spectrum of [4 kHz, 8 kHz]. The joint spectrum is divided into sub-bands. The gains in each sub-band define the spectral envelope. The shape in each sub-band is encoded by embedded spherical vector quantization using trained permutation codes. The gain-shape of $S_{HB}(k)$ represents a true spectral envelope in second band.

The each spectral envelope gain is quantized with 5 bits by uniform scalar quantization and the resulting quantization indices are coded using a two-mode binary encoder. The 5-bit quantization consists in computing the indices 305, rms_index(j), j=0, . . . , 17, as follows:

$$rms_index(j)=\text{round}(\tfrac{1}{2}\log_rms(j)) \quad (1)$$

with the restriction $$-11 \le rms_index(j) \le +20 \quad (2)$$

i.e., the indices are limited by −11 and +20 (32 possible values).

The resulting quantized full-band envelope is then divided into two subvectors:

lower-band spectral envelope: (rms_index(0), rms_index (1), . . . , rms_index(9))

and higher-band spectral envelope:

(rms_index(10), rms_index(11), . . . , rms_index(17)).

These two subvectors are coded separately using a two-mode lossless encoder which switches adaptively between differential Huffman coding (mode 0) and direct natural binary coding (mode 1). Differential Huffman coding is used to minimize the average number of bits, whereas direct natural binary coding is used to limit the worst-case number of bits as well as to correctly encode the envelope of signals which are saturated by differential Huffman coding (e.g., sinusoids). One bit is used to indicate the selected mode to the spectral envelope decoder.

G729.1 Decoder

A functional diagram of the decoder is presented in FIG. 4. The specific case of frame erasure concealment is not considered in this figure. The decoding depends on the actual number of received layers or equivalently on the received bit rate.

If the received bit rate is:

8 kbit/s (Layer 1): The core layer is decoded by the embedded CELP decoder to obtain 401, $\hat{s}_{LB}(n)=s(n)$. Then $\hat{s}_{LB}(n)$ is postfiltered into 402, $\hat{s}_{LB}^{post}(n)$, and postprocessed by a high-pass filter (HPF) into 403, $\hat{s}_{LB}^{qmf}(n)=\hat{s}_{LB}^{hpf}(n)$. The QMF synthesis filterbank defined by the filters $G_1(z)$ and $G_2(z)$ generates the output with a high-frequency synthesis 404, $\hat{s}_{HB}^{qmf}(n)$, set to zero.

12 kbit/s (Layers 1 and 2): The core layer and narrowband enhancement layer are decoded by the embedded CELP decoder to obtain 401, $\hat{s}_{LB}(n)=\hat{s}_{enh}(n)$, and $s_{LB}(n)$ is then postfiltered into 402, $\hat{s}_{LB}^{post}(n)$ and high-pass filtered to obtain 403, $\hat{s}_{LB}^{qmf}(n)=\hat{s}_{LB}^{hpf}(n)$. The QMF synthesis filterbank generates the output with a high-frequency synthesis 404, $\hat{s}_{HB}^{qmf}(n)$ set to zero.

14 kbit/s (Layers 1 to 3): In addition to the narrowband CELP decoding and lower-band adaptive postfiltering, the TDBWE decoder produces a high-frequency synthesis 405, $\hat{s}_{HB}^{bwe}(n)$ which is then transformed into frequency domain by MDCT so as to zero the frequency band above 3000 Hz in the higher-band spectrum 406, $\hat{s}_{HB}^{bwe}(k)$. The resulting spectrum 407, $\hat{s}_{HB}(k)$ is transformed in time domain by inverse MDCT and overlap-add before spectral folding by $(-1)^n$. In the QMF synthesis filterbank the reconstructed higher band signal 404, $\hat{s}_{HB}^{qmf}(n)$ is combined with the respective lower band signal 402, $\hat{s}_{LB}^{qmf}(n)=\hat{s}_{LB}^{post}(n)$ reconstructed at 12 kbit/s without high-pass filtering. Above 14 kbit/s (Layers 1 to 4+): In addition to the narrowband CELP and TDBWE decoding, the TDAC decoder reconstructs MDCT coefficients 408, $\hat{D}_{LB}^{w}(k)$ and 407, $\hat{s}_{HB}(k)$, which correspond to the reconstructed weighted difference in lower band (0-4000 Hz) and the reconstructed signal in higher band (4000-7000 Hz). Note that in the higher band, the non-received sub-bands and the sub-bands with zero bit allocation in TDAC decoding are replaced by the level-adjusted sub-bands of $\hat{s}_{HB}^{bwe}(k)$. Both $\hat{D}_{LB}^{w}(k)$ and $\hat{s}_{HB}(k)$ are transformed into time domain by inverse MDCT and overlap-add. The lower-band signal 409, $\hat{d}_{LB}^{w}(n)$ is then processed by the inverse perceptual weighting filter $W_{LB}(z)^{-1}$. To attenuate transform coding artefacts, pre/post-echoes are detected and reduced in both the lower- and higher-band signals 410, $\hat{d}_{LB}(n)$ and 411, $\hat{s}_{HB}(n)$. The lower-band synthesis $\hat{s}_{LB}(n)$ is postfiltered, while the higher-band synthesis 412, $\hat{s}_{HB}^{fold}(n)$ is spectrally folded by $(-1)^n$. The signals $\hat{s}_{LB}^{qmf}(n)=\hat{s}_{LB}^{post}(n)$ and $\hat{s}_{HB}^{qmf}(n)$ are then combined and upsampled in the QMF synthesis filterbank.

TDBWE Decoder

FIG. 5 illustrates the concept of the TDBWE decoder module. The TDBWE received parameters, which are computed by a parameter extraction procedure, are used to shape an artificially generated excitation signal 502, $\hat{s}_{HB}^{exc}(n)$ according to desired time and frequency envelopes 508, $\hat{T}_{env}(i)$, and 509, $\hat{F}_{env}(j)$. This is followed by a time-domain post-processing procedure.

The quantized parameter set consists of the value $\hat{M}_T$ and of the following vectors: $\hat{T}_{env,1}$, $\hat{T}_{env,2}$, $\hat{F}_{env,1}$, $\hat{F}_{env,2}$, and $\hat{F}$env,3. The quantized mean time envelope is $\hat{M}_T$ used to reconstruct the time envelope and the frequency envelope parameters from the individual vector components, i.e.:

$$\hat{T}_{env}(i)=\hat{T}_{env}^{M}(i)+\hat{M}_T,\ i=0, \ldots, 15 \quad (3)$$

and $$\hat{F}_{env}(j)=\hat{F}_{env}^{M}(j)+\hat{M}_T,\ j=0, \ldots, 11 \quad (4)$$

The decoded frequency envelope parameters $\hat{F}_{env}(j)$ with j=0, . . . , 11 are representative for the second 10 ms frame within the 20 ms superframe. The first 10 ms frame is covered by parameter interpolation between the current parameter set and the parameter set $\hat{F}_{env,old}(j)$ from the preceding superframe:

$$\hat{F}_{env,int}(j)=\tfrac{1}{2}(\hat{F}_{env,old}(j)+\hat{F}_{env}(j)),\ j=0,\ldots,11 \quad (5)$$

The superframe of 503, $\hat{s}_{HB}^{T}(n)$, is analyzed twice per superframe. A filterbank equalizer is designed such that its individual channels match the sub-band division to realize the frequency envelope shaping with proper gain for each channel.

The TDBWE excitation signal 501, exc(n), is generated by 5 ms subframe based on parameters which are transmitted in Layers 1 and 2 of the bitstream. Specifically, the following parameters are used: the integer pitch lag $T_0=\mathrm{int}(T_1)$ or int $(T_2)$ depending on the subframe, the fractional pitch lag frac, the energy $E_c$ of the fixed codebook contributions, and the energy $E_p$ of the adaptive codebook contribution. The parameters of the excitation generation are computed every 5 ms subframe. The excitation signal generation consists of the following steps:

estimation of two gains $g_v$ and $g_{uv}$ for the voiced and unvoiced contributions to the final excitation signal exc(n);

pitch lag post-processing;

generation of the voiced contribution;

generation of the unvoiced contribution; and low-pass filtering.

TDAC Decoder

The TDAC decoder is depicted in FIG. 6. The higher-band spectral envelope is decoded first. The bit indicating the selected coding mode at the encoder may be: 0.fwdarw.differential Huffman coding, 1.fwdarw.natural binary coding. If mode 0 is selected, 5 bits are decoded to obtain an index rms_index(10) in [−11, +20]. Then the Huffman codes associated with the differential indices diff_index(j), j=11, . . . , 17, are decoded. The index 601, rms_index(j), j=11, . . . , 17, is reconstructed as follows:

$$rms_\mathrm{index}(j)=rms_\mathrm{index}(j-1)+\mathrm{diff_index}(j) \quad (6)$$

If mode 1 is selected, rms_index(j), j=10, . . . , 17, is obtained in [−11, +20] by decoding 8.times.5 bits. If the number of bits is not sufficient to decode the higher-band spectral envelope completely, the decoded indices 601, rms_index(j), are kept to allow partial level-adjustment of the decoded higher-band spectrum. The bits related to the lower band, i.e., rms_index(j), j=0, . . . , 9, are decoded in a similar way as in the higher band, including one bit to select mode 0 or 1. The decoded indices are combined into a single vector [rms_index(0) rms_index(1) . . . rms_index(17)], which represents the reconstructed spectral envelope in log domain. This envelope is converted into the linear domain 402 as follows:

$$rms_q(j)=2^{1/2 rms_index(j)} \quad (7)$$

SUMMARY

For low bit rate frequency domain coding, spectral envelope coding is the important step. BWE is one of typical low bit rate coding algorithms. BWE often encodes/decodes some perceptually critical information within bit budget while generating some information with very limited bit budget or without spending any number of bits; it usually comprises frequency envelope coding, temporal envelope coding (optional), and spectral fine structure generation. This invention targets high quality of spectral envelope coding for energy attack signals. Distorted spectral envelope often causes the problem named here spectral pre-echoes existing in the decoded signal segment before the energy attack point. This invention presents several possibilities to avoid spectral pre-echoes. In particular, the invention gives some examples assuming that ITU G.729.1 is in the core layer for a scalable super-wideband codec.

There are three main ways of improving the spectral envelope shaping for decoded energy attack signal in order to reduce the spectral pre-echo. In one embodiment, the method comprises the following steps of: detecting energy attack signal and make sure that current MDCT (or FFT) window covers significant energy portion of energy attack signal; detecting energy attack point location; smoothing the spectral envelope in Log domain or in Linear domain. The method can further comprise the steps of: recording major differences between the smoothed envelope and the unsmoothed envelope such as spectrum tilt difference; decoding the signal by Inverse-MDCT transforming quantized MDCT coefficients with the smoothed envelope, resulting in improved spectrum of signal segment before attack point; filtering the decoded time domain signal segment after the attack point with the recorded difference parameters such as spectrum tilt difference in order to compensate for the spectral distortion of the signal segment after the attack point. The method can further comprise the other steps of: decoding the signal by Inverse-MDCT transforming quantized MDCT coefficients with the smoothed envelope, resulting in improved spectrum of signal segment before energy attack point; decoding the signal by Inverse-MDCT transforming quantized MDCT coefficients with unsmoothed spectral envelope, keeping good spectrum of signal segment after energy attack point; constructing final time domain signal by placing the signal segment before the attack point obtained with the spectral smoothing and keeping the signal segment after the attack point produced without the spectral smoothing.

In another embodiment, the method comprises the following steps of: detecting energy attack signal and make sure that current MDCT (or FFT) window covers significant energy portion of energy attack signal; detecting energy attack point location; decoding the signal by Inverse-MDCT transforming received MDCT coefficients and keeping the good spectrum of signal segment after energy attack point; copying the signal segment without spectral pre-echoes from the signal history buffer to replace the signal segment with spectral pre-echoes before the attack point. The method further comprises the steps of: searching for a signal segment from signal history buffer covered by previous MDCT window to maximize correlation between signal segment without spectral pre-echoes and signal segment with spectral pre-echoes before the attack point; copying the signal segment with the maximum correlation from the signal history buffer to replace the signal segment with spectral pre-echoes before the attack point.

In another embodiment, the method comprises the following steps of: detecting energy attack signal and make sure that current MDCT (or FFT) window covers significant energy portion of energy attack signal; detecting energy attack point location; performing LPC analysis on signal with spectral pre-echoes before energy attack point to have a LPC predictor $A_1(z)$; performing LPC analysis on signal without spectral pre-echoes covered by previous MDCT window to have a LPC predictor $A_2(z)$; filtering the signal segment before the attack point with the above combined filter $A_1(z)/A_2(z)$. The method can use the combined filter expressed in weighted domain:

$$A_1(z/\alpha)/A_2(z/\alpha) \text{ or } A_1(z/\alpha)/A_2(z/\beta),\ 0<\alpha\leq 1,\ 0<\beta\leq 1.$$

BRIEF DESCRIPTION OF THE DRAWINGS

The features and advantages of the present invention will become more readily apparent to those ordinarily skilled in the art after reviewing the following detailed description and accompanying drawings, wherein.

DETAILED DESCRIPTION

The making and using of the embodiments of the disclosure are discussed in detail below. It should be appreciated, however, that the embodiments provide many applicable inventive concepts that can be embodied in a wide variety of specific contexts. The specific embodiments discussed are merely illustrative of specific ways to make and use the embodiments, and do not limit the scope of the disclosure.

For low bit rate frequency domain coding, spectral envelope coding is the important step. BWE is one of typical low bit rate coding algorithms. BWE often encodes/decodes some perceptually critical information within bit budget while generating some information with very limited bit budget or without spending any number of bits; it usually comprises frequency envelope coding, temporal envelope coding (optional), and spectral fine structure generation. The precise description of the spectral fine structure needs a lot of bits, which becomes not realistic for any BWE algorithm. A realistic way is to artificially generate the spectral fine structure and only spend limited budget to code the fine spectral envelope. Obviously, the spectral envelope coding is the most important first step toward successful BWE algorithm.

This invention is mainly related to spectral envelope coding; in particular, it aims to improve the spectral envelope coding of energy attack signal. The typical energy attack signal is castanet music signal; energy attack also exists in any other music signals; it occasionally appears in speech signals. Distorted spectral envelope often causes the problem named here spectral pre-echoes existing in the decoded signal segment before the energy attack point. This invention presents several possibilities to avoid spectral pre-echoes. In particular, the invention gives some examples assuming that ITU G.729.1 is in the core layer for a scalable super-wideband codec.

Figure 1:
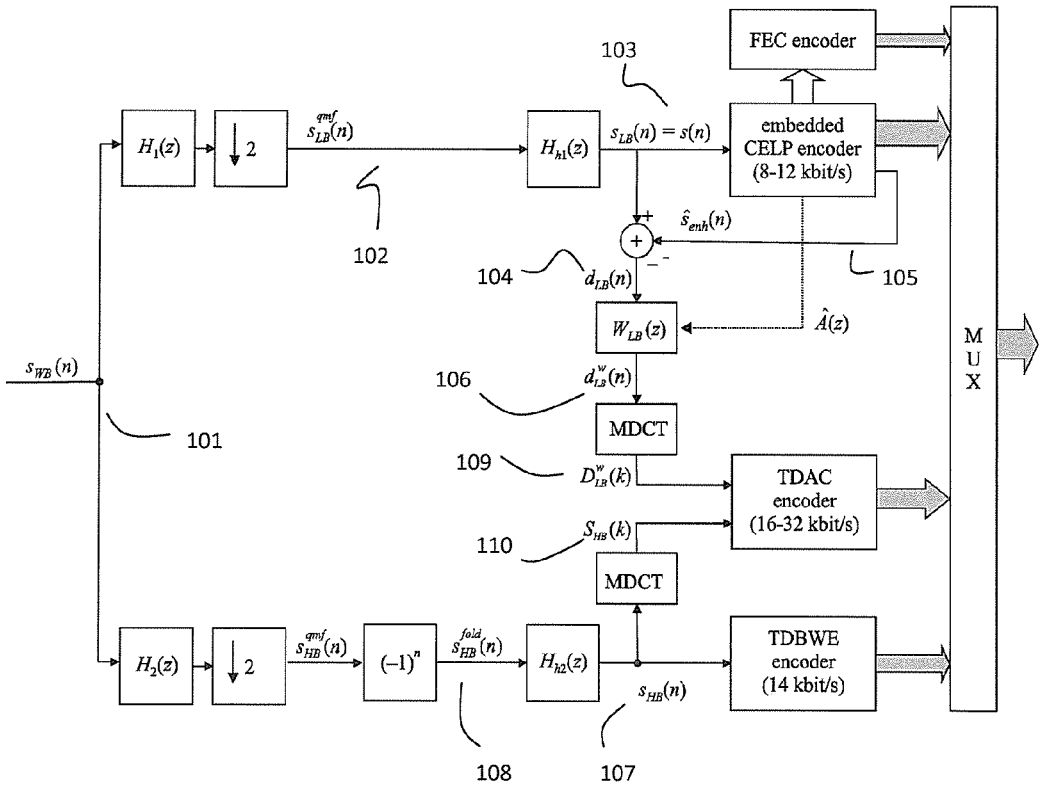
FIG. 1 gives high-level block diagram of the ITU-T G.729.1 encoder.
Figure 2:
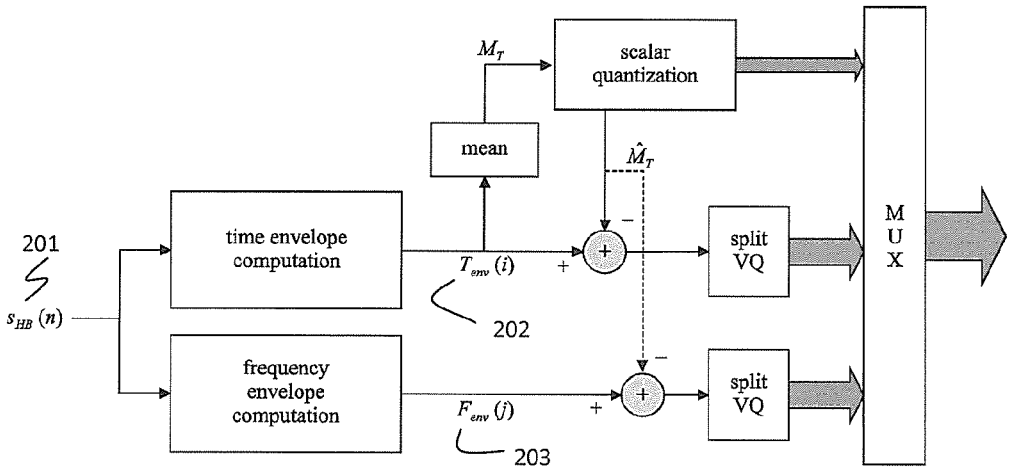
FIG. 2 gives high-level block diagram of the TDBWE encoder for G.729.1.
Figure 3:
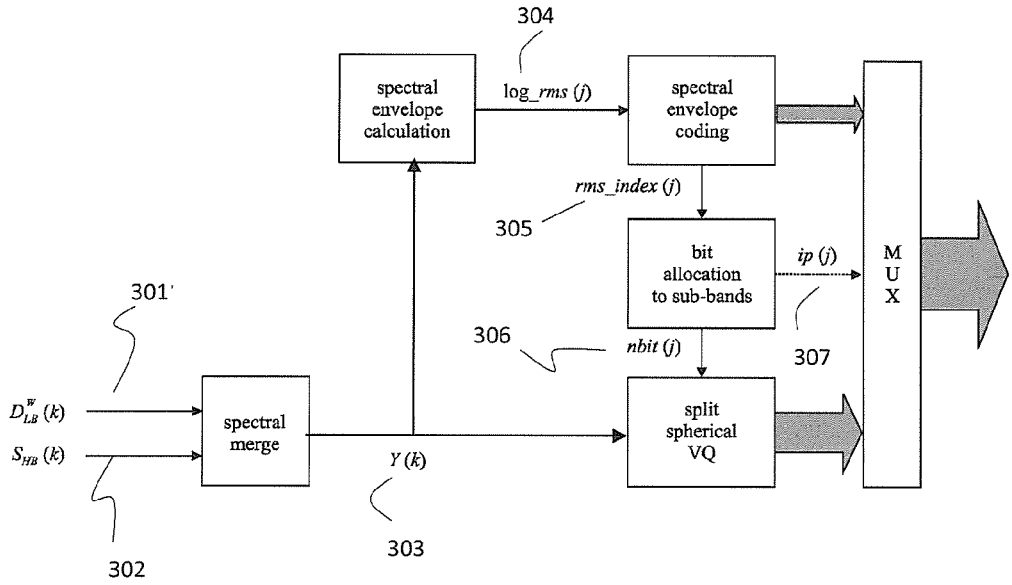
FIG. 3 gives high-level block diagram of the G.729.1 TDAC encoder.
Figure 4:
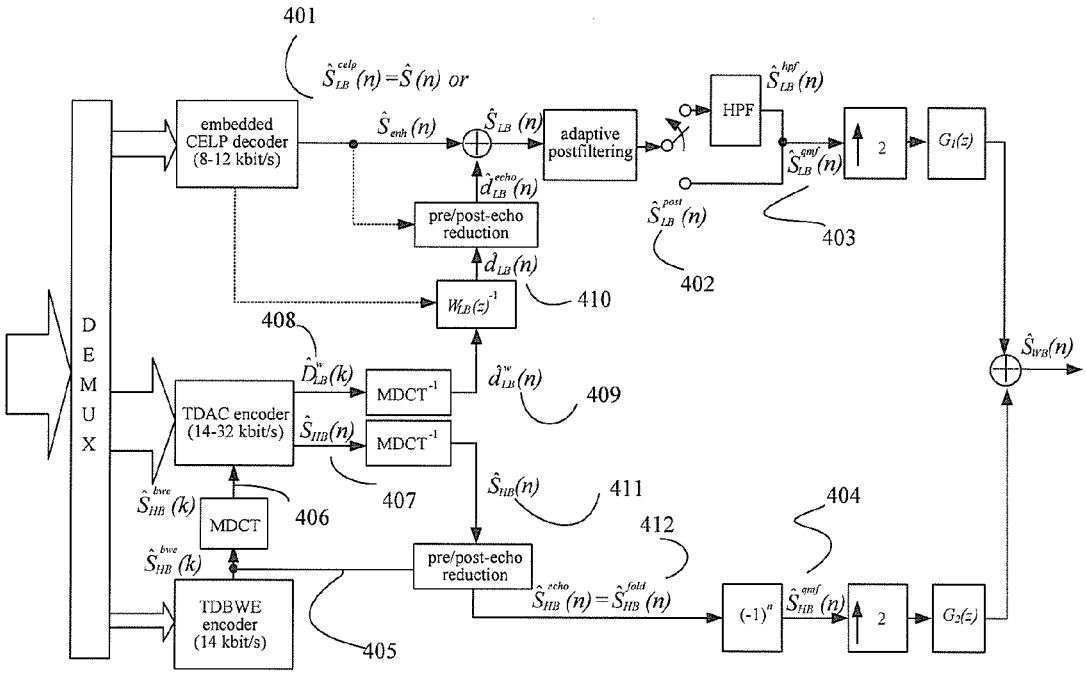
FIG. 4 gives high-level block diagram of the G.729.1 decoder.
Figure 5:
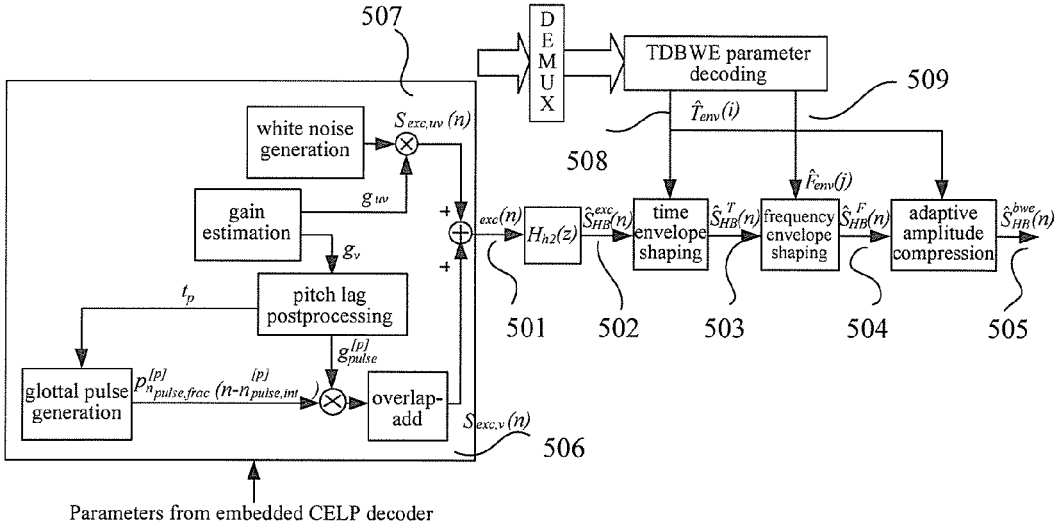
FIG. 5 gives high-level block diagram of the TDBWE decoder for G.729.1.
Figure 6:
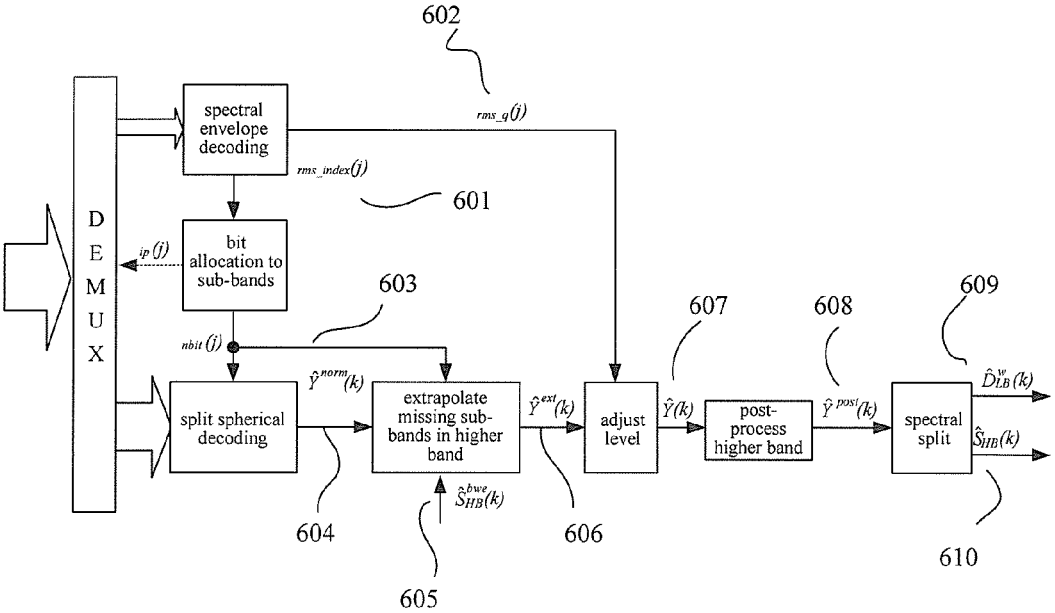
FIG. 6 gives block diagram of the G.729.1 TDAC decoder.
Figure 7:
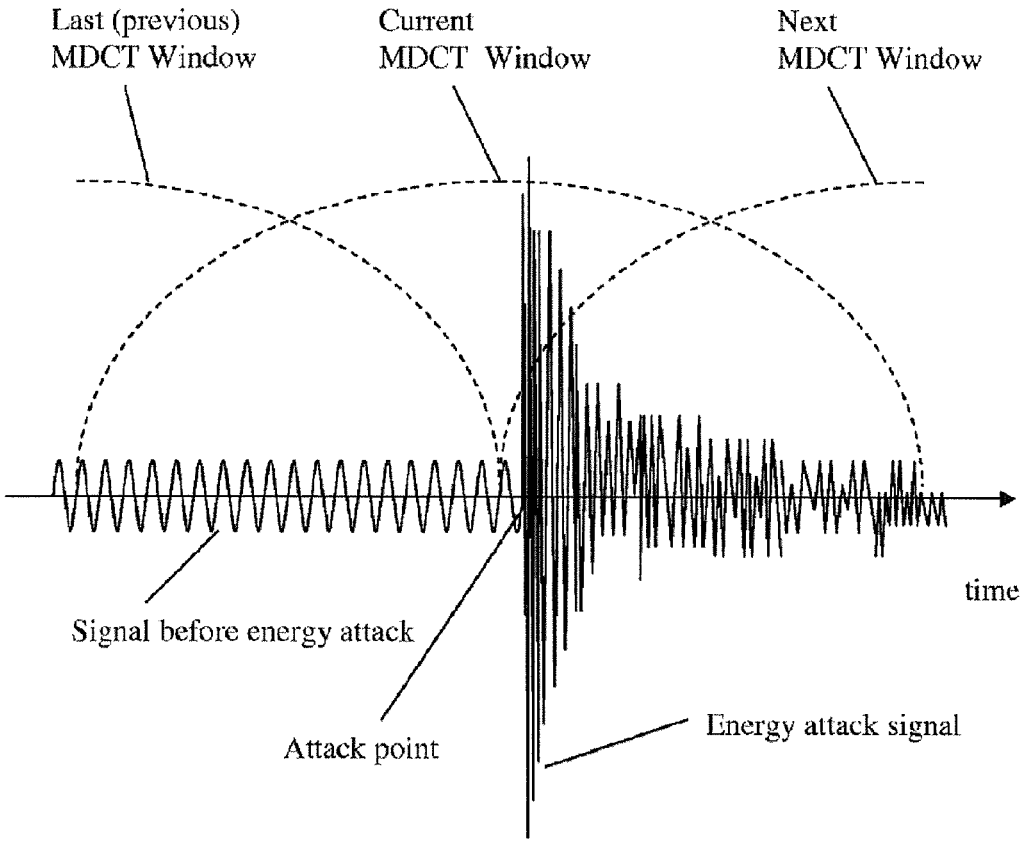
FIG. 7 shows an example of original energy attack signal in time domain.
Figure 8:
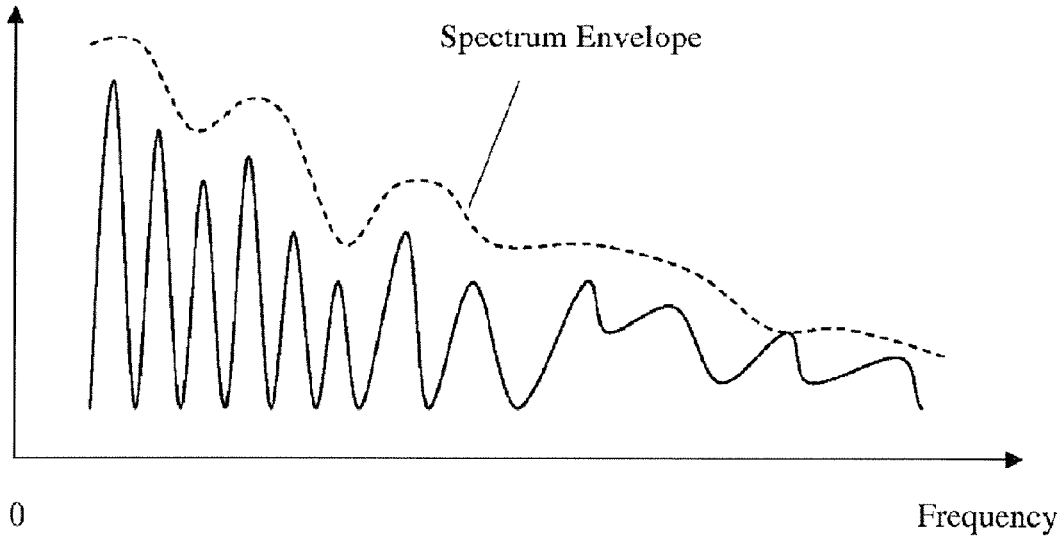
FIG. 8 shows spectrum of the signal before the attack point.
Figure 9:
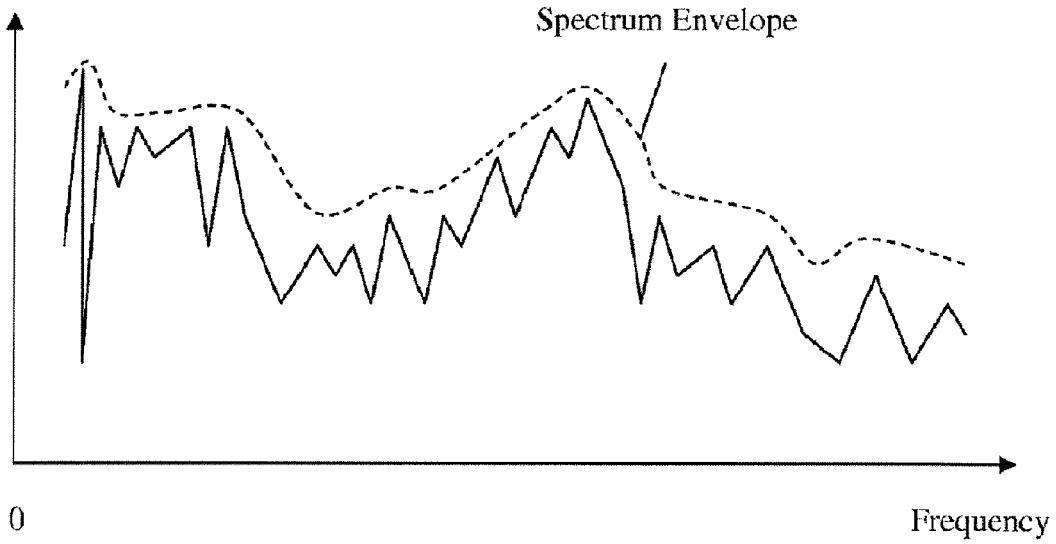
FIG. 9 shows spectrum of the signal after the attack point.
Figure 10:
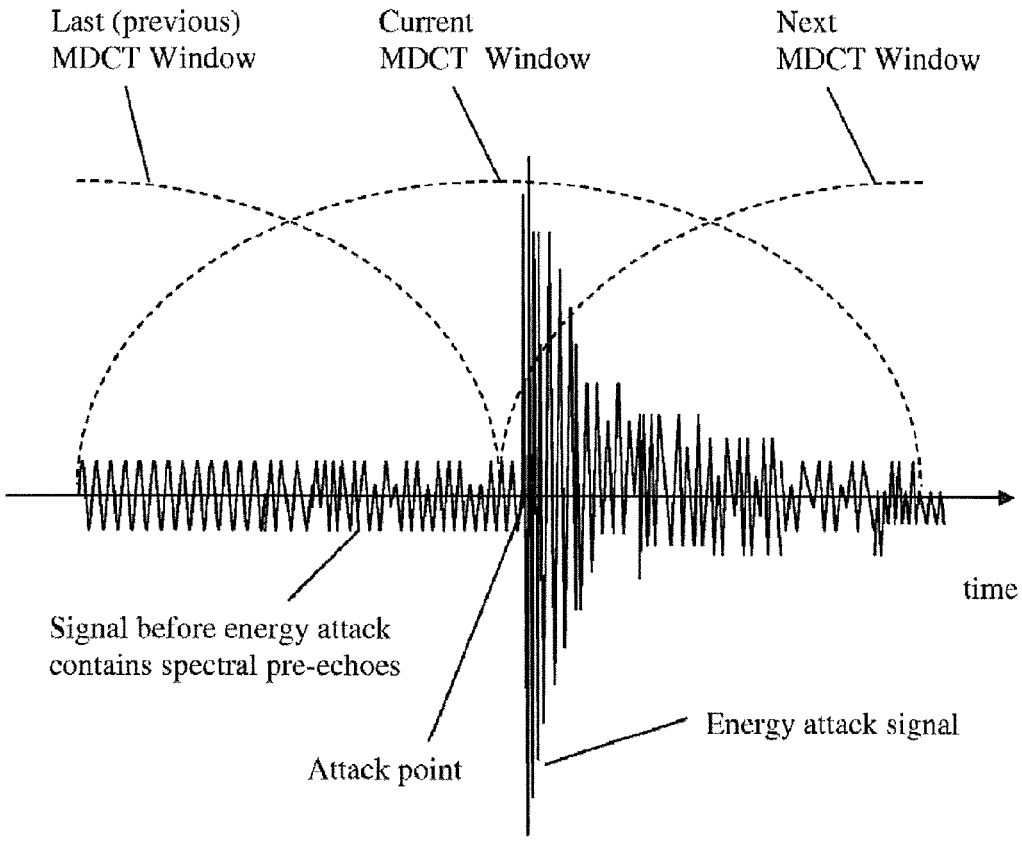
FIG. 10 shows an example of decoded energy attack signal in time domain without modification of the spectral envelope.

FIG. 7 shows a typical energy attack signal in time domain. As shown in the figure, before the energy attack point, the signal energy is relatively low and the signal spectrum is stable; just after the energy attack point, not only the signal energy suddenly increases a lot but also the spectrum dramatically changes. MDCT transformation is performed on a windowed signal; two adjacent windows are overlapped each other; the window size could be as large as 40 ms with 20 ms overlapped in order to increase the efficiency of MDCT-based audio coding algorithm. For energy attack signal, one window could cover two totally different segments of signals, which can be observed through FIG. 7, FIG. 8, and FIG. 9; FIG. 8 shows the example spectrum of the signal segment before the energy attack point; FIG. 9 shows the example spectrum of the signal segment after the energy attack point; it can be seen that the two spectral envelopes could be very different. Because the signal energy after the attack point is much higher, it can be imagined that the spectral envelope of the MDCT coefficients based on the current windowed signal is more likely toward the spectrum of the signal segment after attack point (as seen in FIG. 9). If the fine spectrum structure is roughly coded or generated without spending enough number of bits, after the inverse MDCT transformation, the decoded time domain signal segment before the attack point will significantly contain the spectrum contents of the signal segment after the attack point, resulting in clearly audible distortion. FIG. 10 shows the distortion example of the time domain signal directly decoded without modifying/improving the spectral envelope; the decoded signal segment before the attack point contains spectral pre-echoes which causes clearly audible distortion due to the fact that the decoded spectrum before the attack point is influenced a lot by the decoded spectrum after the attack point and the decoded spectrum continuity before the attack point is destroyed. Adaptively reducing the window size could reduce the distortion; but also reduce the coding efficiency and increase the algorithm complexity.

This invention proposed several possible methods to improve the spectral envelope coding of energy attack signal, which includes frequency domain modification and/or time domain modification. The frequency domain method can comprise the following steps: Detect the energy attack signal; make sure the current window covers the significant energy portion of the energy attack signal. Detect the attack point location.

When the energy attack signal is detected, smooth the spectral envelope in Log domain or in Linear domain:

$$\hat{F}_{env}(j)=\alpha\cdot\hat{F}_{env,old}(j)+(1-\alpha)\cdot\hat{F}_{env}(j),\ j=0,1, \tag{8}$$

$\alpha$ is an adaptive coefficient (0<.alpha.<1) to control the spectral envelope smoothing; $\hat{F}_{env}(j)$ represents the current spectral envelope; $\hat{F}_{env,old}(j)$ is the previous spectral envelope. Record the major difference between the smoothed envelope and the unsmoothed envelope such as spectrum tilt difference.

Decode the signal by Inverse-MDCT transforming the quantized MDCT coefficients with the smoothed envelope, resulting in the improved spectrum of the signal segment before the attack point.

Filter the decoded time domain signal segment after the attack point with the recorded difference parameters such as spectrum tilt difference in order to compensate for the spectral distortion of the signal segment after the attack point; because the energy is suddenly and dramatically changed, the small spectral distortion of the signal segment just after the attack point can be masked and less audible.

The above approach keeps using one inverse-MDCT transformation to save the computational complexity. If the complexity limitation is allowed, the following approach can be chosen:

Detect the energy attack signal; make sure the current window covers the significant energy portion of the energy attack signal. Detect the attack point location.

When the energy attack signal is detected, strongly smooth the spectral envelope in Log domain or in Linear domain with the equation (8) and relatively a large a ($0<\alpha<=1$) to control the spectral envelope smoothing.

Decode the signal by Inverse-MDCT transforming the quantized MDCT coefficients with the smoothed envelope, resulting in the improved spectrum of the signal segment before the attack point. Decode the signal by Inverse-MDCT transforming the quantized MDCT coefficients with the unsmoothed spectral envelope, keeping the good spectrum of the signal segment after the attack point.

Construct the final time domain signal by placing the signal segment before the attack point obtained with the spectral smoothing and keeping the signal segment after the attack point produced without the spectral smoothing; a small segment of Overlap-Add may be applied at the attack point to smooth the time domain signal.

The two Inverse-MDCT transformations with/without spectral envelope smoothing keep the same initial memory from previous Inverse-MDCT transformation and the memory update from the Inverse-MDCT transformation without spectral envelope smoothing will be used for next Inverse-MDCT transformation.

An approach only based on the time domain modification can also generate a good result, which comprises the following steps: Detect the energy attack signal; make sure the current window covers the significant energy portion of the energy attack signal. Detect the attack point location.

Decode the signal by Inverse-MDCT transforming the quantized MDCT coefficients with the unsmoothed spectral envelope, keeping the good spectrum of the signal segment after the attack point.

Search for a signal segment from the signal history buffer covered by the previous MDCT window to maximize the correlation between the signal segment without spectral pre-echoes and the signal segment with spectral pre-echoes before the attack point.

Copy the signal segment without spectral pre-echoes from the signal history buffer to replace the signal segment with spectral pre-echoes before the attack point; Overlap-Add may be applied at the segment boundaries to avoid discontinuity of the time domain signal.

Another time domain method can comprise the following steps: Detect the energy attack signal; make sure the current window covers the significant energy portion of the energy attack signal. Detect the attack point location.

Decode the signal by Inverse-MDCT transforming the quantized MDCT coefficients with the unsmoothed spectral envelope, keeping the good spectrum of the signal segment after the attack point. Do LPC analysis on the signal with spectral pre-echoes before the attack point to have a LPC predictor $A_1$ (z).

Do LPC analysis on the signal without spectral pre-echoes covered by the previous MDCT window to have a LPC predictor $A_2$ (z). Use the LPC predictor $A_1$ (z) to do inverse-filtering of the signal with spectral pre-echoes before the attack point to flatten the spectrum; then pass the spectrum-flattened residual signal through the synthesis filter described by $1/A_2$ (z); the resulting modified signal by filtering the signal segment with the above combined filter $A_1(z)/A_2(z)$ contains no spectral pre-echoes or much less spectral pre-echoes. The combined filter can be expressed in weighted domain:

$$A_1(z/\alpha)/A_2(z/\alpha) \text{ or } A_1(z/\alpha)/A_2(z/\beta),\ 0<\alpha\leq 1,\ 0<\beta\leq 1.$$

Figure 11:
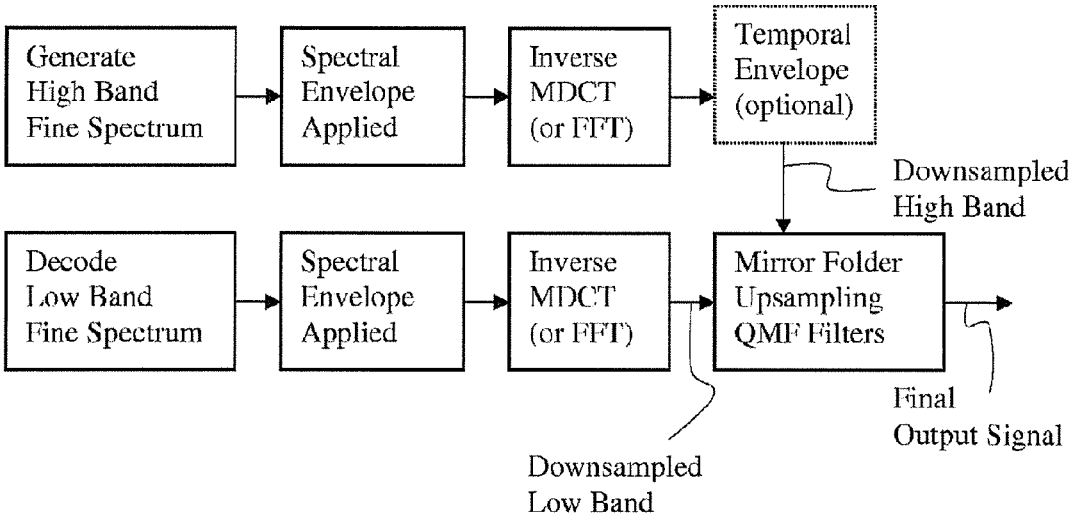
FIG. 11 shows an example of basic principle of audio decoding with BWE.

FIG. 11 gives an example without spectral envelope modification of basic audio decoding where the high band is decoded with BWE algorithm. Normally, the high band fine spectral structure generated by BWE has more distortion than the decoded fine spectral structure as shown in low band so that the inverse transformed high band signal could have more spectral pre-echoes than the decoded low band signal. Theoretically, the above proposed methods can be applied to both high band signal and low band signal to reduce the spectral pre-echoes of energy attack signal.

The above description can be summarized as three main ways of improving the spectral envelope shaping for decoded energy attack signal in order to reduce the spectral pre-echo. In one embodiment, the method comprises the following steps of: detecting energy attack signal and make sure that current MDCT (or FFT) window covers significant energy portion of energy attack signal; detecting energy attack point location; smoothing the spectral envelope in Log domain or in Linear domain. The method can further comprise the steps of: recording major differences between the smoothed envelope and the unsmoothed envelope such as spectrum tilt difference; decoding the signal by Inverse-MDCT transforming quantized MDCT coefficients with the smoothed envelope, resulting in improved spectrum of signal segment before attack point; filtering the decoded time domain signal segment after the attack point with the recorded difference parameters such as spectrum tilt difference in order to compensate for the spectral distortion of the signal segment after the attack point. The method can further comprise the other steps of: decoding the signal by Inverse-MDCT transforming quantized MDCT coefficients with the smoothed envelope, resulting in improved spectrum of signal segment before energy attack point; decoding the signal by Inverse-MDCT transforming quantized MDCT coefficients with unsmoothed spectral envelope, keeping good spectrum of signal segment after energy attack point; constructing final time domain signal by placing the signal segment before the attack point obtained with the spectral smoothing and keeping the signal segment after the attack point produced without the spectral smoothing.

In another embodiment, the method comprises the following steps of: detecting energy attack signal and make sure that current MDCT (or FFT) window covers significant energy portion of energy attack signal; detecting energy attack point location; decoding the signal by Inverse-MDCT transforming received MDCT coefficients and keeping the good spectrum of signal segment after energy attack point; copying the signal segment without spectral pre-echoes from the signal history buffer to replace the signal segment with spectral pre-echoes before the attack point. The method further comprises the steps of: searching for a signal segment from signal history buffer covered by previous MDCT window to maximize correlation between signal segment without spectral pre-echoes and signal segment with spectral pre-echoes before the attack point; copying the signal segment with the maximum correlation from the signal history buffer to replace the signal segment with spectral pre-echoes before the attack point. In another embodiment, the method comprises the following steps of: detecting energy attack signal and make sure that current MDCT (or FFT) window covers significant energy portion of energy attack signal; detecting energy attack point location; performing LPC analysis on signal with spectral pre-echoes before energy attack point to have a LPC predictor $A_1$ (z); performing LPC analysis on signal without spectral pre-echoes covered by previous MDCT window to have a LPC predictor $A_2$ (z); filtering the signal segment before the attack point with the above combined filter $A_1(z)/A_2(z)$. The method can use the combined filter expressed in weighted domain:

$$A_1(z/\alpha)/A_2(z/\alpha) \text{ or } A_1(z/\alpha)/A_2(z/\beta),\ 0<\alpha\leq 1,\ 0<\beta\leq 1.$$

Figure 12:
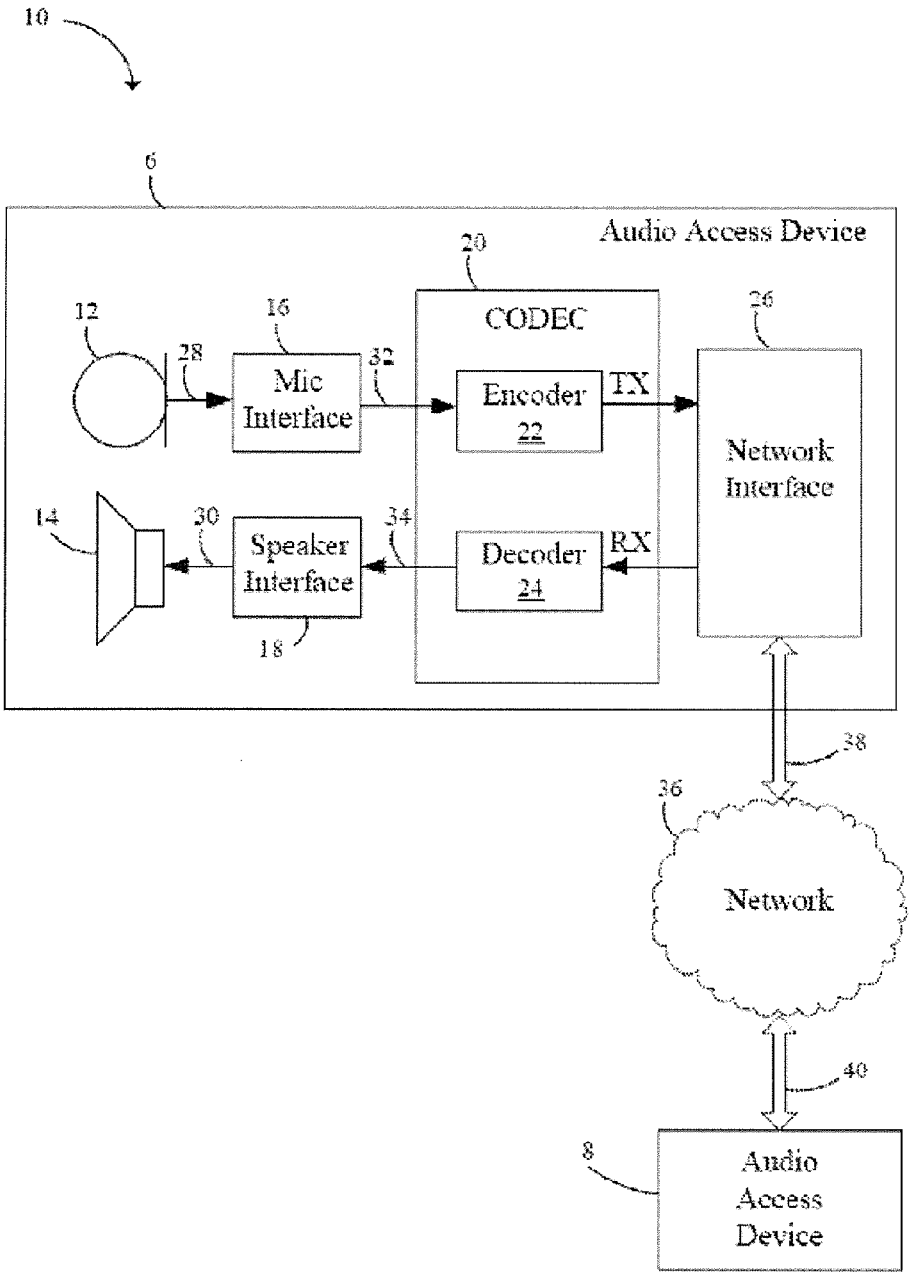
FIG. 12 illustrates communication system according to an embodiment of the present invention.

FIG. 12 illustrates communication system 10 according to an embodiment of the present invention. Communication system 10 has audio access devices 6 and 8 coupled to network 36 via communication links 38 and 40. In one embodiment, audio access device 6 and 8 are voice over internet protocol (VOIP) devices and network 36 is a wide area network (WAN), public switched telephone network (PTSN) and/or the internet. Communication links 38 and 40 are wireline and/or wireless broadband connections. In an alternative embodiment, audio access devices 6 and 8 are cellular or mobile telephones, links 38 and 40 are wireless mobile telephone channels and network 36 represents a mobile telephone network.

Audio access device 6 uses microphone 12 to convert sound, such as music or a person's voice into analog audio input signal 28. Microphone interface 16 converts analog audio input signal 28 into digital audio signal 32 for input into encoder 22 of CODEC 20. Encoder 22 produces encoded audio signal TX for transmission to network 26 via network interface 26 according to embodiments of the present invention. Decoder 24 within CODEC 20 receives encoded audio signal RX from network 36 via network interface 26, and converts encoded audio signal RX into digital audio signal 34. Speaker interface 18 converts digital audio signal 34 into audio signal 30 suitable for driving loudspeaker 14.

In an embodiments of the present invention, where audio access device 6 is a VOIP device, some or all of the components within audio access device 6 are implemented within a handset. In some embodiments, however, Microphone 12 and loudspeaker 14 are separate units, and microphone interface 16, speaker interface 18, CODEC 20 and network interface 26 are implemented within a personal computer. CODEC 20 can be implemented in either software running on a computer or a dedicated processor, or by dedicated hardware, for example, on an application specific integrated circuit (ASIC). Microphone interface 16 is implemented by an analog-to-digital (A/D) converter, as well as other interface circuitry located within the handset and/or within the computer. Likewise, speaker interface 18 is implemented by a digital-to-analog converter and other interface circuitry located within the handset and/or within the computer. In further embodiments, audio access device 6 can be implemented and partitioned in other ways known in the art.

In embodiments of the present invention where audio access device 6 is a cellular or mobile telephone, the elements within audio access device 6 are implemented within a cellular handset. CODEC 20 is implemented by software running on a processor within the handset or by dedicated hardware. In further embodiments of the present invention, audio access device may be implemented in other devices such as peer-to-peer wireline and wireless digital communication systems, such as intercoms, and radio handsets. In applications such as consumer audio devices, audio access device may contain a CODEC with only encoder 22 or decoder 24, for example, in a digital microphone system or music playback device. In other embodiments of the present invention, CODEC 20 can be used without microphone 12 and speaker 14, for example, in cellular base stations that access the PTSN.

The above description contains specific information pertaining to the several possibilities to avoid spectral pre-echoes existing in the decoded signal segment before the energy attack point. However, one skilled in the art will recognize that the present invention may be practiced in conjunction with various encoding/decoding algorithms different from those specifically discussed in the present application. Moreover, some of the specific details, which are within the knowledge of a person of ordinary skill in the art, are not discussed to avoid obscuring the present invention. The drawings in the present application and their accompanying detailed description are directed to merely example embodiments of the invention. To maintain brevity, other embodiments of the invention which use the principles of the present invention are not specifically described in the present application and are not specifically illustrated by the present drawings.

It will also be readily understood by those skilled in the art that materials and methods may be varied while remaining within the scope of the present invention. It is also appreciated that the present invention provides many applicable inventive concepts other than the specific contexts used to illustrate embodiments. For example, in alternative embodiments of the present invention. Accordingly, the appended claims are intended to include within their scope such processes, machines, manufacture, compositions of matter, means, methods, or steps.

What is claimed is:

1. A signal processing method, comprising:

receiving, by an access device, an encoded energy attack signal of an audio signal in a frequency domain, wherein the encoded energy attack signal is encoded from an energy attack signal in a time domain by performing a transformation with a current transform window, and wherein the current transform window covers a significant energy portion of the energy attack signal;

decoding the encoded energy attack signal into the time domain by performing an inverse-transformation;

detecting an energy attack point of the decoded energy attack signal in the time domain;

performing LPC analysis on signal segment with spectral pre-echoes before the decoded energy attack point to obtain a LPC predictor A1(z);

performing LPC analysis on signal segment without spectral pre-echoes covered by a previous transform window to obtain a LPC predictor A2(z);

filtering the signal segment before the energy attack point with combined filter A1(z)/A2(z).

2. The method of claim 1, wherein the energy attack point is a time point at which energy of the decoded energy attack signal suddenly increases.

3. The method of claim 1, wherein the combined filter is expressed in weighted domain: $A1(z/\alpha)/A2(z/\alpha)$ or $A1(z/\alpha)/A2(z/\beta)$, $0<\alpha\leq 1$, $0<\beta\leq 1$.

4. An access device, comprising:

a receiver, configured to receive an encoded energy attack signal of an audio signal in a frequency domain, wherein the encoded energy attack signal is encoded from an energy attack signal in a time domain by performing a transformation with a current transform window, and wherein the current transform window covers a significant energy portion of the energy attack signal;

a processor, configured to decode the encoded energy attack signal into the time domain by performing an inverse-transformation; detect an energy attack point of the decoded energy attack signal in the time domain; perform LPC analysis on signal segment with spectral pre-echoes before the decoded energy attack point to obtain a LPC predictor A1(z); perform LPC analysis on signal segment without spectral pre-echoes covered by a previous transform window to obtain a LPC predictor A2(z); and filter the signal segment before the energy attack point with combined filter A1(z)/A2(z).

5. The device of claim 4, wherein the energy attack point is a time point at which energy of the decoded energy attack signal suddenly increases.

6. The device of claim 4, wherein the combined filter is expressed in weighted domain: $A1(z/\alpha)/A2(z/\alpha)$ or $A1(z/\alpha)/A2(z/\beta)$, $0<\alpha\leq 1$, $0<\beta\leq 1$.

7. A communication system, comprising:

a network side device;

an access device;

wherein the network side device is configured to send an encoded energy attack signal to the audio access device, wherein the encoded energy attack signal is encoded from an energy attack signal in a time domain by performing a transformation with a current transform window, and wherein the current transform window covers a significant energy portion of the energy attack signal; and wherein the access device is configured to receive the encoded energy attack signal of an audio signal in a frequency domain; decode the encoded energy attack signal into the time domain by performing an inverse-transformation; detect an energy attack point of the decoded energy attack signal in the time domain; perform LPC analysis on signal segment with spectral pre-echoes before the decoded energy attack point to obtain a LPC predictor A1(z); perform LPC analysis on signal segment without spectral pre-echoes covered by a previous transform window to obtain a LPC predictor A2(z); and filter the signal segment before the energy attack point with combined filter A1(z)/A2(z).

8. The system of claim 7, wherein the energy attack point is a time point at which energy of the decoded energy attack signal suddenly increases.

9. The system of claim 7, wherein the combined filter is expressed in weighted domain: $A1(z/\alpha)/A2(z/\alpha)$ or $A1(z/\alpha)/A2(z/\beta)$, $0<\alpha\leq 1$, $0<\beta\leq 1$.

10. The system of claim 7, wherein the communication system is a voice over internet protocol (VOIP) system.

11. The system of claim 7, wherein the communication system is a cellular telephone system.

12. A computer-readable non-transitory medium storing instructions which, when executed by a processor, cause the processor to perform a process, wherein the process comprises:

receiving, by an access device, an encoded energy attack signal of an audio signal in a frequency domain, wherein the encoded energy attack signal is encoded from an energy attack signal in a time domain by performing a transformation with a current transform window, and wherein the current transform window covers a significant energy portion of the energy attack signal;

decoding the encoded energy attack signal into the time domain by performing an inverse-transformation;

detecting an energy attack point of the decoded energy attack signal in the time domain;

performing LPC analysis on signal segment with spectral pre-echoes before the decoded energy attack point to obtain a LPC predictor A1(z);

performing LPC analysis on signal segment without spectral pre-echoes covered by a previous transform window to obtain a LPC predictor A2(z);

filtering the signal segment before the energy attack point with combined filter A1(z)/A2(z).

* * * * *